US006645066B2

(12) United States Patent
Gutta et al.

(10) Patent No.: US 6,645,066 B2
(45) Date of Patent: Nov. 11, 2003

(54) SPACE-CONDITIONING CONTROL EMPLOYING IMAGE-BASED DETECTION OF OCCUPANCY AND USE

(75) Inventors: Srinivas Gutta, Buchanan, NY (US); Miroslav Trajkovic, Ossining, NY (US); Antonio José Colmanarez, Maracaibo (VE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/988,945

(22) Filed: Nov. 19, 2001

(65) Prior Publication Data

US 2003/0096572 A1 May 22, 2003

(51) Int. Cl.[7] ..... F24F 11/08
(52) U.S. Cl. ..... 454/229
(58) Field of Search ..... 454/229, 239, 454/256; 236/49.3

(56) References Cited

U.S. PATENT DOCUMENTS 5,326,028 A * 7/1994 Kano et al. ..... 236/49.3
5,764,146 A * 6/1998 Baldwin et al. ..... 340/567
6,189,799 B1 * 2/2001 Parker et al. ..... 236/51
6,331,964 B1 * 12/2001 Barone ..... 367/128

* cited by examiner

*Primary Examiner*—Harold Joyce
(74) *Attorney, Agent, or Firm*—Gregory L. Thorne

(57) ABSTRACT

Cameras and image processing techniques are applied to the control of HVAC systems. Occupancy is detected using head-counting or motion detection. Activities are recognized in images and image sequences by machine-recognition techniques. The nature of activities, the intensity of activities, the number of occupants and their activities, etc. are all inferred from images and image sequences and used to predict current loads and/or required control signals for regulating an HVAC system.

17 Claims, 2 Drawing Sheets

SPACE-CONDITIONING CONTROL EMPLOYING IMAGE-BASED DETECTION OF OCCUPANCY AND USE

BACKGROUND OF THE INVENTION

1. Field of the Invention

The invention relates to heating ventilating and air conditioning control based on real-time imaging of occupied spaces to determine load and more particularly to such control that uses, among other things, techniques for counting individuals and tracking their movement to determine conditioned-space occupancy rates.

2. Background

There are a number of techniques for controlling heating ventilating and air conditioning (HVAC). Most commonly, they are regulated based on temperature. But pure temperature-based regulation gives an incomplete picture of the load because human comfort also involves humidity and contaminant control, which may be regulated by dehumidification and ventilation components of a system, respectively. For example, carbon dioxide ($CO_2$), moisture, or other contaminant levels may rise to unacceptable levels due to high occupancy, smoking, cooking, and other such activities. To address these issues, large-scale HVAC systems may employ contaminant sensors such as $CO_2$ sensors and humidity sensors in the control of HVAC systems. However, the sensors used in such systems are expensive and often inaccurate or prone to failure. Also, placement of such sensors may be based on use and structure patterns in a space that are changed thereby reducing their effectiveness. For example, local occupancy patterns in a large space may be completely ignored by such control devices.

SUMMARY OF THE INVENTION

A control system for heating ventilating and air conditioning (HVAC) systems employs video cameras and image processing techniques to detect occupancy and use patterns in a conditioned space. The HVAC system is preferably capable of delivering local effect, such as through zone-control, spot-cooling, heating, or ventilating, exhaust, etc. By counting occupants by zone and/or controlled area, energy can be saved and comfort and safety maximized.

Examples of environments to which the invention is applicable include simple zone-controlled systems such as in residences and large buildings. In such cases, cameras may be mounted in each zone to permit a head-count of occupants in real time. The control system may make predictions based on the detected zone-occupancy outdoor temperature and humidity, current temperature and humidity, to control the supply of heating, ventilating, and cooling effect delivered to the occupied zone.

Another example of an application is a factory. Image processing systems may be trained to recognize, in real-time images, not only occupancy but activities as well. For example, the system could detect welding or painting activity, activities that have visible manifestations, and control the local exhaust rate accordingly. Spot coolers could be controlled to turn off even when the user takes a break. Yet another example is a high occupancy space such as a trade-show venue. Movement patterns in such environments are otherwise very difficult to detect.

The invention will be described in connection with certain preferred embodiments, with reference to the following illustrative figures so that it may be more fully understood. With reference to the figures, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENTS

Figure 1:
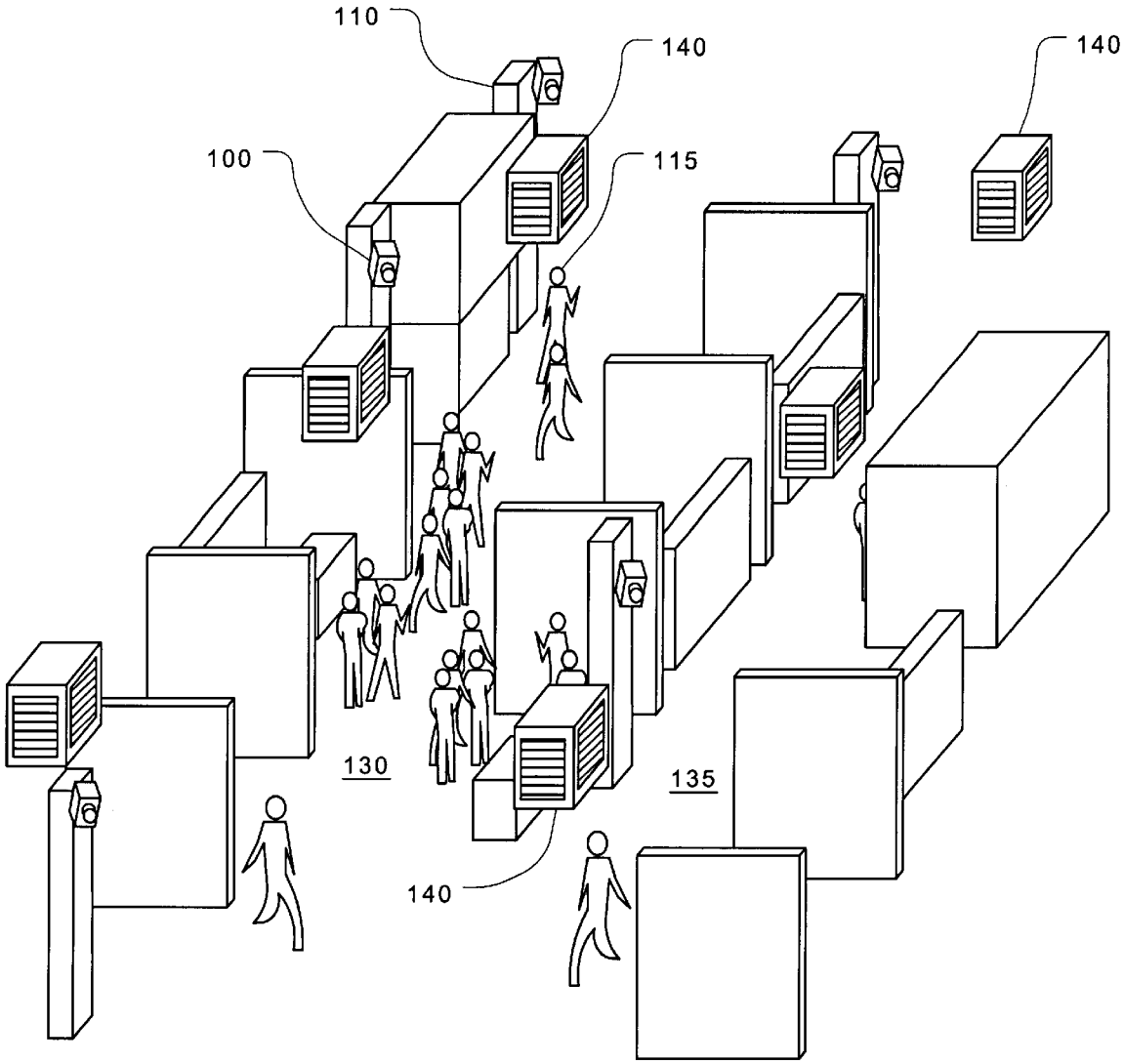
FIG. 1 is an illustration of a context in which an embodiment of the invention may be applied.

Referring to FIG. 1, a public place such as a tradeshow, gallery, or museum, has a variety of occupied sub-spaces 125, 130, 135 within a larger space 180. The occupancy rates of the sub-spaces 125–135 vary. The occupancy rate of sub-space 130 is relatively high while that of sub-space 135 is low. The occupancy rate of sub-space 130 is intermediate. Respective discharge registers 140 that project space-conditioning effect locally condition the air in each sub-space 125–135. The discharge registers 140 may be connected to a common duct (not shown) with respective dampers (not shown) to control the rate of flow of air through each of them. Under the circumstances illustrated in FIG. 1, it is desirable for the greatest flow of conditioning air to be through the discharge registers 140 that have the greatest impact on the sub-space 130 and for the lowest flow to be through the discharge registers 140 that have the greatest impact on the sub-space 135.

Cameras 110 located throughout the larger space 180 detect occupancy of respective fields of view using person-counting techniques that are well-known in the field of image processing. Although multiple cameras 110 are shown, the number required depends on the presence of obstructions, the shape of the space 180, the field of view of the cameras, etc. In some cases, only one camera may be needed if a clear view of the occupied space is possible. Also, a single system may be used to control HVAC for an entire building or complex with multiple rooms, each potentially having multiple sub-spaces. Obviously in such cases multiple cameras would likely be required.

Figure 2:
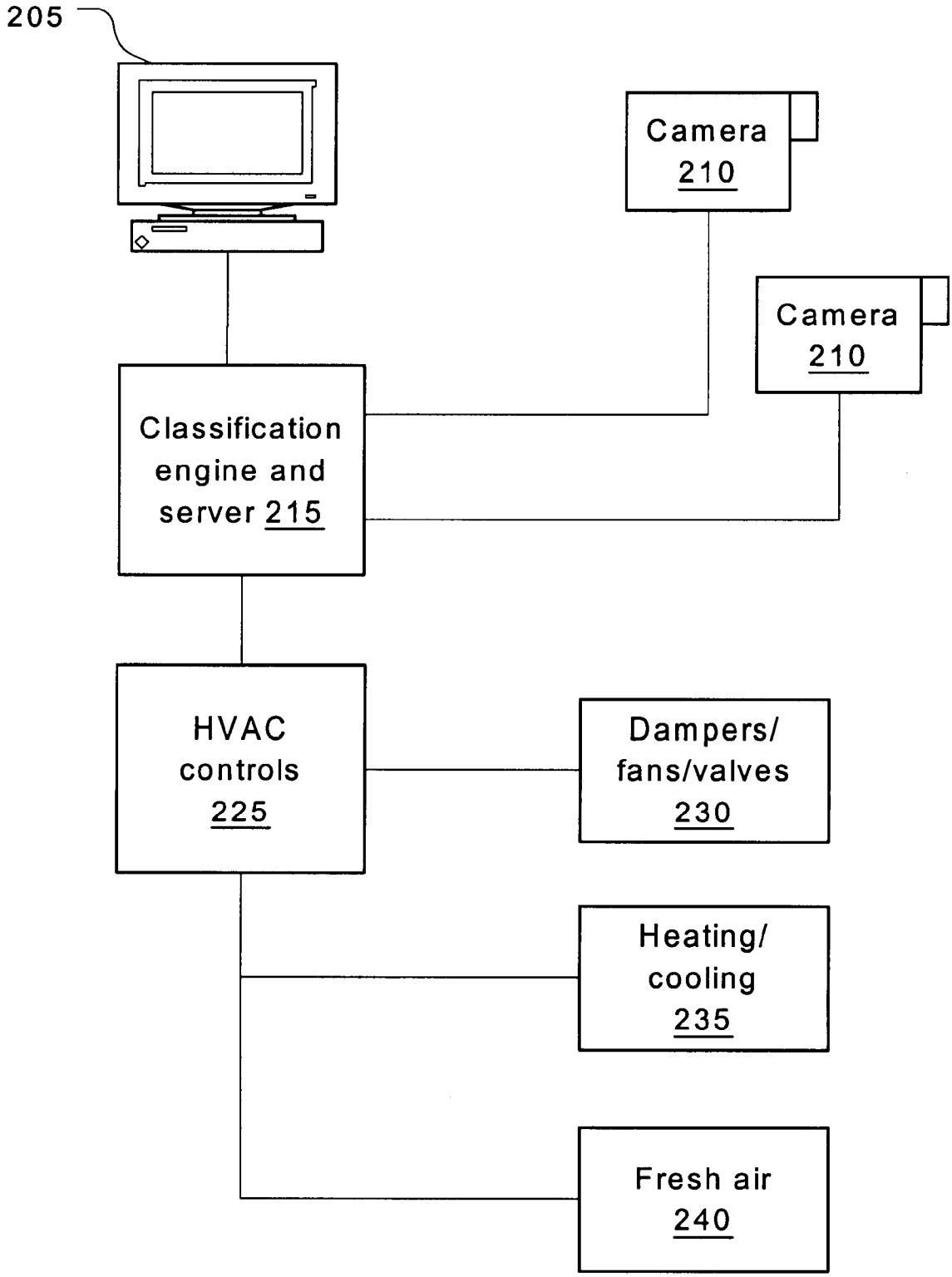
FIG. 2 is a functional block diagram of a control system for implementing an embodiment of the invention.

Referring now also to FIG. 2, images are continuously generated by the cameras 210 (which correspond to the cameras 110) and supplied to a classification engine 215. The classification engine 215 sends control signals to an HVAC final control system 225 connected to dampers 230, heating and cooling sources 235 and fresh air controls (economizer) 240, as well as any other suitable end effectors known in the field of HVAC.

In a simple embodiment of the invention, the system may count heads and generate an occupancy rate, which may then be tied to a suitably calibrated control signal. A person of ordinary skill in the field may calculate a standard load based on occupancy and this can be converted to a demand. Although a thermostat would ultimately respond as the temperature changed in response to occupancy, an imaging system that counts heads can respond more quickly.

A more advanced system could take account of activity level. For example, if many people are dancing at a wedding reception, the sensitivity of a transfer function for the control signal may be adjusted based on the amount of movement detected. The image-processing problem in this case may be one of simply motion detection. Blob-motion detection (size of coefficients of the motion vector field as typically calculated in mpeg-2 motion-compensation type compression) combined with head-counting could be used to generate a suitable control signal lookup table.

Another level of control may be the recognition of particular types of activities. For example, a welder in a factory may generate bright sources that may easily be recognized in an image. Thus, a local exhaust system may be regulated according to the welder's activity, turning off the exhaust when the welder is setting up or taking a break and turning it on when the welder resumes welding. Other examples of activities that may be recognized using image and/or video processing techniques include painting, walking, exercising, sitting, etc. In most cases, motion detection and head counting may be correlated to load, which may then be translated into a lookup table of control signals for each particular system. Such an intermediate motion/head count table could be applicable to a wide range of activities. Alternatively, just the motion field may suffice if occupants are moving sufficiently, such as in a trade show since the area of movement would correlate to the occupancy rate and the rate of movement to activity level. A motion vector field alone would provide this information.

To control multiple local HVAC effectors using a single imaging system, the only requirement is to partition the image so that each sub-space corresponds to a particular partition. Since sub-spaces will normally be fixed in the field of view of a given imaging device, the partitioning can be done based on fixed coordinates that are stored in the classification engine 215.

Recognizing the kinds of events and activities that may be used to control HVAC delivery in real-time images present relatively trivial problems for network classifiers. For example, it would be simple problem to create a Bayesian classifier or neural network classifier to recognize events that correspond to increases and decreases in load. Head-counting, for example, is an area for which reliable techniques have been developed and widely published. One type of head-counting strategy involves removing material from an image that is solely attributable to the fixed background. This is called background subtraction. After the background is removed from further analysis, the image is segmented using algorithms such as region-growing and edge-connecting. Segments may be joined using further algorithms and shapes corresponding to individuals identified and counted. There are normally many intermediate steps involved, such as image-processing to enhance contrast and make edges or regions better defined. These vary according to the particular technique being employed, but would be easily within the competence of a person in the relevant image processing fields.

It will be evident to those skilled in the art that the invention is not limited to the details of the foregoing illustrative embodiments, and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A control system for a space conditioning system, comprising; at least one optical imaging device configured to capture at least one image of a scene in a conditioned space;

at least one processor having an output and connected to receive said at least one image from said at least one optical imaging device;

said at least one processor being configured to detect from said at least one image at least one of an occupancy rate, an occupant activity rate, and an occupant activity class and to generate a control signal for controlling a space conditioning system responsively thereto.

2. A control system as in claim 1, wherein said at least one image is multiple images and said processor is programmed to detect motion in said multiple images, said occupant activity rate detected by said at least one processor being at least partially based upon detected motion.

3. A control system as in claim 1, wherein said at least one processor is configured to count occupants in said at least one image, said control signal being responsive to a result of counting occupants in said at least one image.

4. A method of controlling a space-conditioning system, comprising the steps of:

capturing an image of a scene of a conditioned space;

identifying at least one of an occupancy rate, an occupant activity rate, and an occupant class by analyzing at least one image resulting from said step of capturing;

controlling at least a portion of a space-conditioning system responsively to a result of said step of identifying.

5. A method as in claim 4, wherein said step of capturing includes receiving an image using a digital camera.

6. A method as in claim 4, wherein said step of identifying includes segmenting an image to count individuals present.

7. A method as in claim 4, wherein said step of identifying includes subtracting a background image from a current image to determine occupancy rates.

8. A method as in claim 7, wherein said step of identifying includes recognizing a class of behavior of occupants in said image.

9. A method as in claim 4, wherein said step of identifying includes recognizing a class of behavior of occupants in said image.

10. A method as in claim 4, wherein said step of controlling includes deriving a control signal from a lookup table correlating occupant count with control signal values.

11. A method as in claim 4, wherein said step of identifying includes generating a motion vector field from a sequence of current images.

12. A method as in claim 11, wherein said step of generating includes segmenting said current images.

13. A method of controlling space-conditioning system, comprising the steps of:

capturing an image of a space to be conditioned;

counting a number of occupants in said image;

comparing said number to a previous number;

adjusting a cooling capacity of said space-conditioning responsively to a result of said step of comparing.

14. A method as in claim 13, wherein said step of generating includes segmenting said current images.

15. A method of controlling a space-conditioning system for an area, the method comprising:

imaging a scene of a conditioned space;

identifying an occupancy rate in two or more sub portions of the area by analyzing at least one image resulting from said step of imaging; and controlling a portion of a space-conditioning system corresponding to a sub portion of the area responsively to a result of said step of identifying.

16. A method as in claim 15, wherein said controlling comprises directing additional cooling from the portion of the space-conditioning system corresponding to a sub portion of the two or more sub portions having a higher occupancy rate.

17. A control system for a space conditioning system, comprising;

at least one optical imaging device configured to capture at least one image of a scene in a conditioned space;

at least one processor having an output and connected to receive said at least one image from said at least one optical imaging device;

said at least one processor being configured to detect from said at least one image, an occupant activity class and to generate a control signal for controlling a space conditioning system responsively thereto.

* * * * *